United States Patent [19]

Morini

[11] 4,100,788

[45] Jul. 18, 1978

[54] BLANKING AND FORMING PRESS FOR SHEET METAL CAPS

[76] Inventor: Rino Morini, Via San Francesco 35, Imola (Province of Bologna), Italy

[21] Appl. No.: 784,864

[22] Filed: Apr. 4, 1977

[30] Foreign Application Priority Data

Apr. 13, 1976 [IT] Italy ..... 3399 A/76

[51] Int. Cl.[2] ..... B21D 24/16

[52] U.S. Cl. ..... 72/329; 72/351

[58] Field of Search ..... 113/120 H; 72/329, 336, 72/351

[56] References Cited

U.S. PATENT DOCUMENTS

| | | | |
|---|---|---|---|
| 2,411,503 | 11/1946 | Calleson et al. | 113/120 H |
| 3,664,172 | 5/1972 | Cvacho | 113/120 H |
| 3,855,862 | 12/1974 | Moller | 113/120 H |

*Primary Examiner*—Lowell A. Larson

*Attorney, Agent, or Firm*—Guido Modiano; Albert Josif

[57] ABSTRACT

A blanking and forming press for sheet metal caps having a fixed cross member, a sleeve constituting the blanking knife housed in the fixed cross member, first and second cross members supported mobile relative to the fixed cross member on its opposed sides, a rod connected at its one end to the first cross member and at its other end to a forming and blanking punch, a cylindrical die supported by the second cross member mobile coaxially to the rod and defining a blanking knife cooperating with the knife defined by the sleeve to form, as the mobile cross members approach each other, a cap member by permanent deformation of a discoidal element cut by the sleeve penetrating into the die.

2 Claims, 10 Drawing Figures

16
11
5
24
34
62
56

25
64

63
49
46

61

BLANKING AND FORMING PRESS FOR SHEET METAL CAPS

BACKGROUND OF THE INVENTION

This invention relates to a blanking and forming press for sheet metal caps.

In traditional presses of the aforesaid type, the blanking and forming are carried out by a punch which moves relative to a counter-punch or die against the return force of elastic springs. The stroke of the punch gives rise to considerable squashing of the springs which, thus subjected to repeated high stress, are frequently fractured.

SUMMARY OF THE INVENTION

The object of the present invention is to provide a press in which said disadvantages are effectively obviated.

This object is attained by a press comprising a fixed cross member, at least one cylindrical seat provided in said cross member, a sleeve slidably housed in said seat and with a terminal portion projecting from said seat and shaped externally as a circular edge constituting the blanking knife, elastic means acting axially on the sleeve and arranged to keep it resting against a stop in said seat, a shoulder provided on said seat against which the sleeve abuts when moved in opposition to said elastic means, a rod guided axially in the sleeve and connected at its upper end to a first cross member supported mobile relative to said fixed cross member, a forming and blanking punch connected to the free end of said rod, a second cross member supported mobile relative to said fixed cross member on the side opposite that on which the first mobile cross member is situated, a cylindrical die supported by said second cross member mobile coaxially to the rod and defining by means of an inner edge a blanking knife cooperating with the outer knife defined by said sleeve, a cylindrical element positioned inside said die and comprising an upper surface in the form of a circular rim arranged to abut against the lower end of said sleeve and a well to receive the punch during the cap forming, motor means for driving said first and second cross members in a reciprocating manner relative to the fixed cross member such that firstly, when the mobile cross members and fixed cross member are spaced apart, the sheet metal is positioned between the sleeve and die, and then as the cross members approach each other the sheet metal is locked between the edge of the die and a presser element which can be loaded against return springs, then a discoidal element is cut by the sleeve penetrating into the die, the discoidal element is gripped between the opposing surfaces of the sleeve and cylindrical element, the punch penetrates into the well in the cylindrical element consequently forming the cap by permanent deformation of the discoidal element, the peripheral edge of said cap is trimmed by a cutting edge of the punch cooperating with the inner edge of the cylindrical element, and finally the mobile cross members are withdrawn from the fixed cross member and the cap is removed.

BRIEF DESCRIPTION OF THE DRAWINGS

Further characteristics of the present invention will be more evident from the detailed description given hereinafter of one embodiment illustrated by way of example in the accompanying drawings, in which.

DESCRIPTION OF THE PREFERRED EMBODIMENTS

Figure 1:
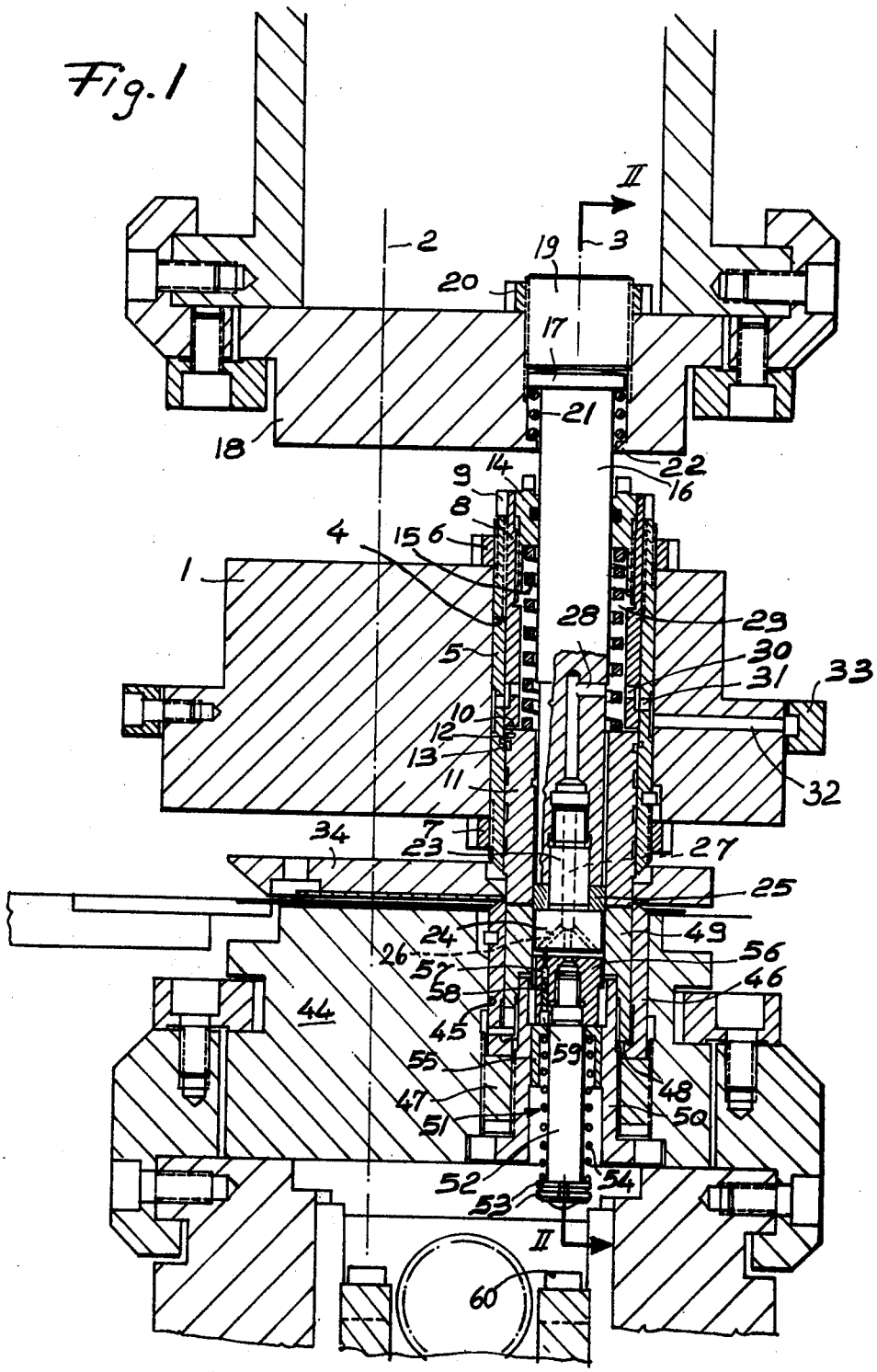
FIG. 1 is an elevation on a transverse plane of those parts of the press which relate to the blanking and forming members.

With reference to said figures, a stationary cross or base member 1 is supported laterally by respective shoulders, not shown on the drawing but constructed in accordance with known methods.

The cross member 1 comprises two parallel rows, 2 and 3, of seats each of which supports blanking and forming members.

In the description given hereinafter only the members relative to a single blanking and forming unit are described.

In relation to such a unit, the seat in the cross member 1 is indicated by 4. This seat is of cylindrical shape and houses a tube 5 which projects partially from the upper and lower surfaces of the cross member 1. The projecting parts of the tube 5 are provided with outer threads on which ring nuts 6, 7 are screwed for axially locking the tube 5.

The upper portion of the tube 5 is provided internally with a thread into which is screwed a bush 8 provided upperly with a toothed collar 9 for engagement with a tightening key.

The lower end of the bush 8 provides an abutment shoulder 10 for a sleeve 11 guided in that portion of the tube 5 lying below the bush 8.

Figure 2:
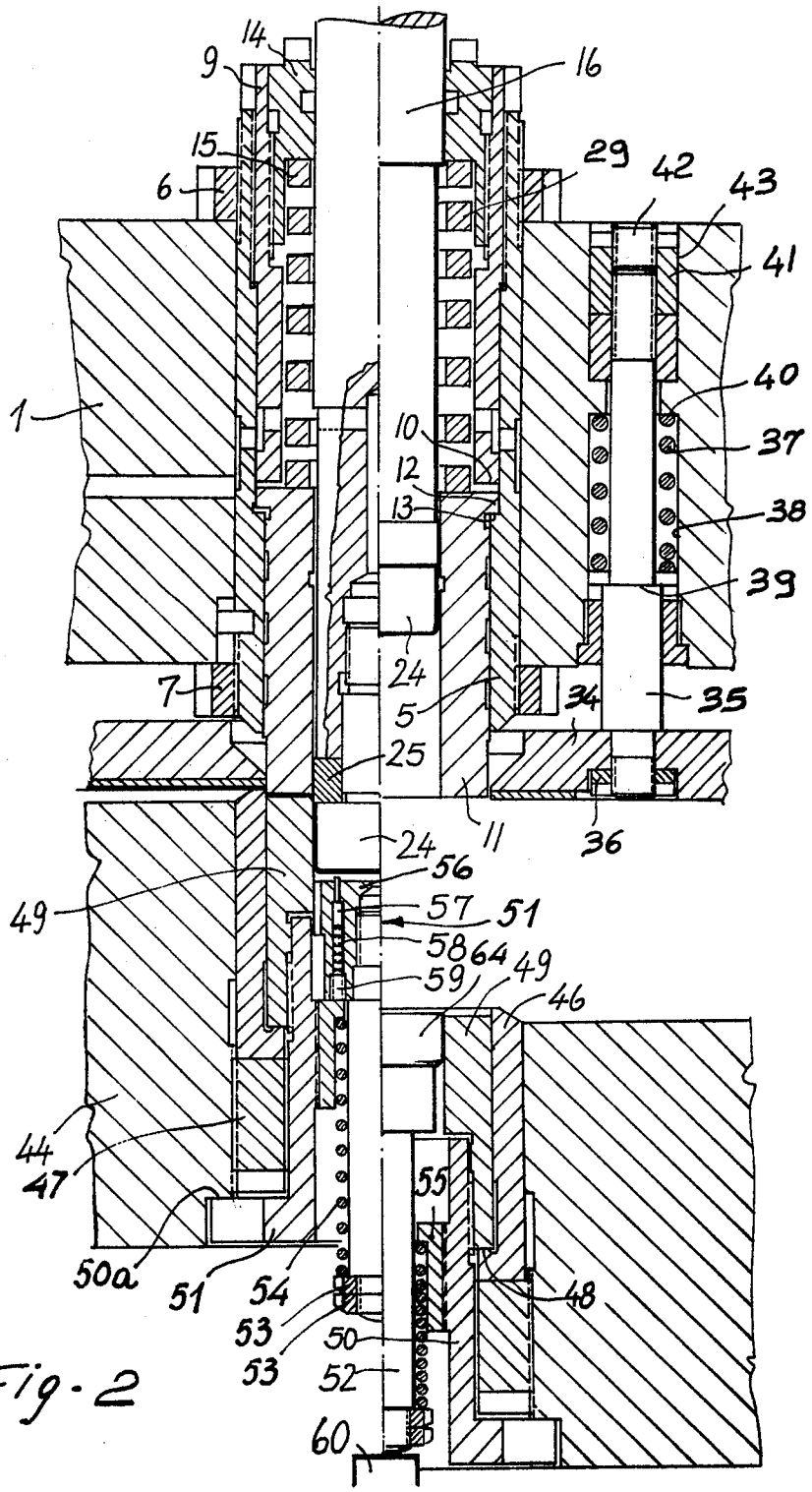
FIG. 2 is a section on the line II—II of FIG. 1, and FIGS. 3, 4, 5, 6, 7, 8, 9 and 10 show different stages in the operation of the press.

The top of the sleeve 11 comprises a outer collar 12 of diameter greater than the underlying portion and guided between the shoulder 10 and a step 13 shown in FIG. 2.

The bush 8 is threaded internally over its upper portion and a gland 14 is screwed therein provided with teeth for engagement with a suitable operating tool. Between the gland 14 and head of the sleeve 11 there is a spring 15 subjected to compression, which keeps the collar 12 resting on the step 13 when the press is not operating.

A cylindrical rod 16 with its upper end shaped as an enlargement 17 is guided in the gland 14 and sleeve 5. This upper end is connected to a mobile ram or cross member 18 of the press which, by means of members which are not shown, but for example of reciprocating type, is moved relative to the fixed cross member 1.

The rod 16 rests by the enlargement 17 against a nut 19 threaded into the cross member 18 and fixed by a locking nut 20.

The rod 16 is retained at the cross member 18 by a spring 21 disposed between the annular portion of the enlargement 17 which projects from the rod 16, and a step 22 provided in the mobile cross member 18.

In the lower end of the rod 16 there is provided an axial seat in which engages the cylindrical shank 23 of a forming punch 24.

A cutting ring 25 is disposed between the forming punch 24 and rod 16, and in practice constitutes the guide support for the rod 16 in the sleeve 11. The outer diameter of the ring 25 is slightly greater than the diameter of the punch 24, and its lower peripheral edge constitutes the cutter for trimming the edge of the formed cap, as will be evident hereinafter.

The punch 24 is provided with a plurality of channels 26 which open at its lower surface and which branch from a single axial channel 27 extending in the rod 16 to a position above the sleeve 11. A channel 28 branches radially from the channel 27 and opens in the interspace defined by the rod 16 and bush 8. The interspace, indicated by 29, communicates by way of holes 30 in the bush 8 and holes 31 in the tube 5, with a duct 32 provided in the fixed cross member 1 and connected by a connector 33 to a source of compressed air. Annular grooves provided in the outer periphery of the tube 5 and bush 8 connect the duct 32 to the holes 31 and these latter to the holes 30 respectively.

Below the cross member 1 there is provided a plate 34 acting as a presser element for the sheet metal from which the caps are to be formed. The plate 34 is suspended from a plurality of stems 35 (FIG. 2) guided in the fixed cross member 1. Each stem is connected to the plate 34 by ring nuts 36 and urged to descend by springs 37 housed in a seat 38 in the cross member 1. The springs 37 act on a shoulder 39 of the stem 35, and at the other end abut on a shoulder 40 in the seat 38. The upper end of the stems is threaded and a nut 41 is screwed thereon, and locked by a dowel 42. The nut 41 has a smooth outer surface and is able to slide in a hole 43 provided in the cross member 1.

It is apparent that by adjusting the position of the nut 41 on the stem 35, the vertical height of the plate 34 relative to an underlying reference plane may be fixed.

Below the plate 34 there is a second mobile cross member 44 driven with reciprocating motion relative to the fixed cross member 1.

Seats are provided in rows, 2, 3 in the mobile ram or cross member 44 for housing the other parts of the press which cooperate with the punch 24 and sleeve 11 in blanking and forming the caps. These seats are indicated by 45 and dies 46 are guided therein. The dies 46 have an inner diameter to receive the lower end of the sleeve 11 with minimum possible tolerance, and rest lowerly on a ring 47 screwed into a threaded portion of the seat 45. The dies 46 comprise a lower inner step 48 on which a perfectly aligned cylindrical drawing element 49 rests, this being of the same thickness as the sleeve 11 and traversed axially by a bore. A sleeve 50 is screwed into the bottom of the cylindrical element 49 and rests by an enlarged lower portion against a flat surface 50*a* of the mobile cross member 44.

The sleeve 50 acts as a guide for an expelling unit indicated overall by 51. This expelling unit comprises a rod 52 to the bottom of which are screwed a ring nut and locking nut 53 which act as a stop for a spring 54 wound about the rod 52 and resting by its top on an inner lip of a bush 55 screwed into the sleeve 50.

A head 56 screwed on to the threaded extension of the rod 52 rests on the bush 55. The head 56 is guided in the cylindrical element 49 and comprises three axial holes distributed at an angle of 120°, in which pins 57 projecting from the upper surface of the head 56 are guided. The pins 57 are of mushroom shape and are loaded by springs 58 which rest on a dowel 59 screwed into the head 56 to close said axial holes. The rod 52 is arranged to rest on a stop 60 during the descent of the mobile cross member 44 for expelling the caps which otherwise would remain retained inside the cylindrical element 49.

The operation of the press described will be more evident from a description of its stages of operation, as shown by the sequence of FIGS. 3 to 10.

Figures 3, 4, 5, 6, 7, 8, 9, 10:
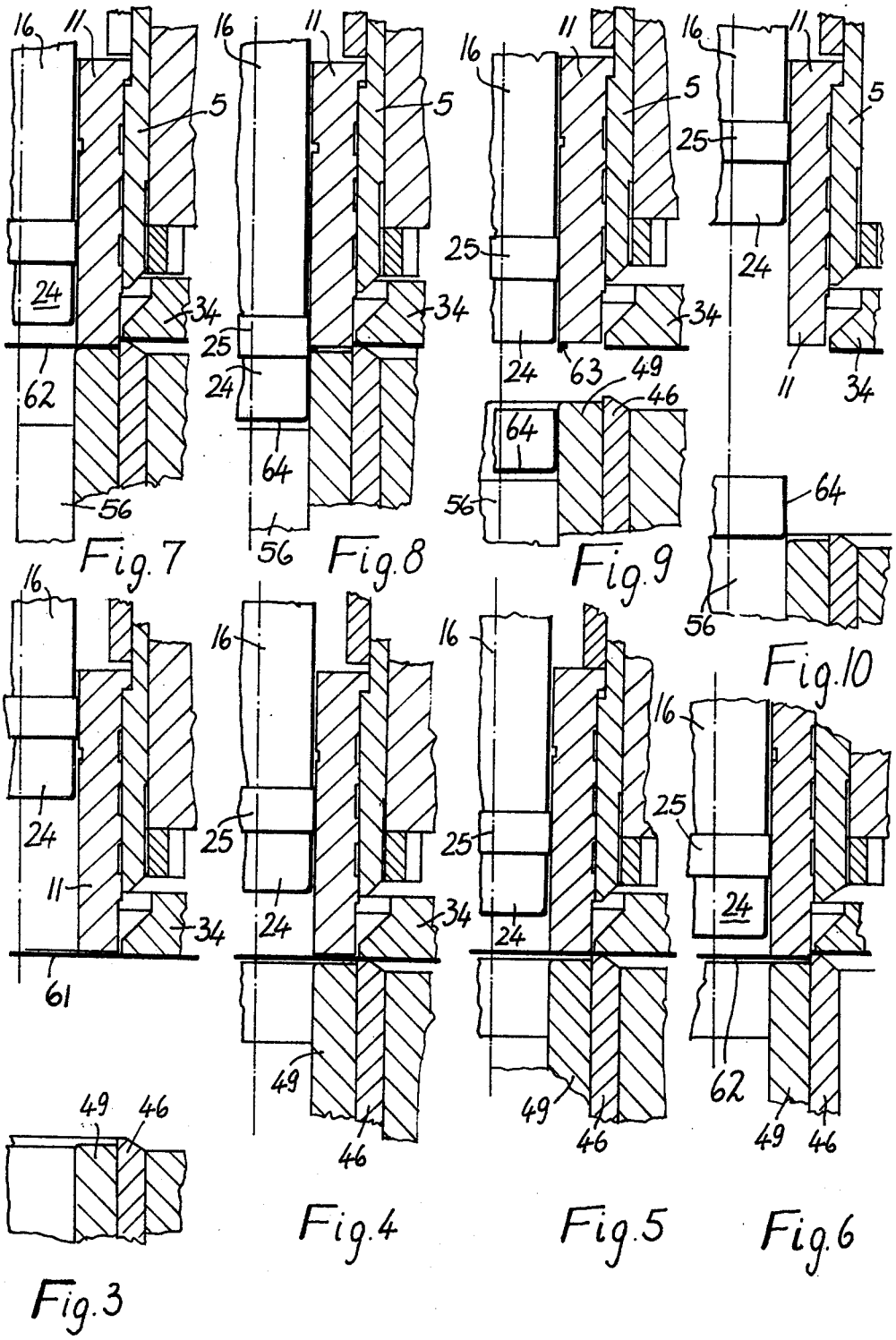

At the beginning of the operational cycle, the press is as shown in FIG. 3, i.e., with the mobile cross members 18 and 44 spaced apart from the fixed cross member 1, i.e., raised and lowered respectively.

The sheet metal from which the caps are to be shaped is indicated by 61 in FIG. 3. This is fed so as to be practically tangential to the lower plane of the plate 34. After positioning the sheet metal below the punches, the cross member 44 is raised so that the dies 46 are brought into contact with the lower surface of the plate 34, so as to firmly hold the sheet metal 61 (FIG. 4).

Continuing the upward stroke of the cross member 44, the plate 34 is raised against the force of the springs 37, until the sheet metal rests on the lower surface of the cutting sleeve 11. In the meantime, because of the simultaneous descent of the cross member 18, the forming punch 24 has approached the upper surface of the sheet metal (see FIG. 5). As the cross member 44 raises still further, a disc 62 is cut and falls into the well defined by the upper edge of the die 46 lying above the end surface of the cylindrical elements 49 (FIG. 6).

During this stage, the sleeve 11 which had been thrust downwards by the spring 15 is now raised by the effect of the lifting thrust exerted by the dies 46, until it abuts against the shoulder 10 of the bushes 8. In this manner, as the cross member 18 is lowered, the cutting force provided thereby is able to directly discharge itself on to the sheet metal and is not neutralised by the yielding of the springs 15.

Examining now the cycle of operations from FIG. 7, it will be seen that the disc 62 remains locked between the opposing ends of the sleeves 11 and the cylindrical elements 49 by the effect of the elastic pressure exerted by the springs 15 on the sleeves 11. As the punch 24 descends, see FIG. 8, the disc 62 is deformed to assume the shape of a cylindrical cap 64 complementary to the shape of the punch 24. When the punch 24 has completely penetrated into the cylindrical element 49, the ring 25 trims off a portion 63 which remains held between the opposing ends of the sleeve 11 and cylindrical element 49. When formation of the cups 64 is complete (FIG. 8) the mobile cross members again withdraw from the fixed cross member. The expelling member 51 makes contact at 60 before the mobile cross member 44 has reached the end of its lower stroke and brakes the descent of the cap 64 which consequently remains raised above the edges of the cylindrical element 49 as shown in FIGS. 9 and 10. The caps 64 and trimmed portions 63 are then removed from the press at this point by suitable removal means such as compressed air jects. It should be noted that, as usual, to facilitate the forming operations the metal sheets are coated with a liquid which facilitates their sliding but which can create a sucker effect when the cap is in the position of FIG. 10. To prevent this, pins 57 are provided to maintain a layer of air between the caps and the surface of the heads 56.

The invention completely attains the stated objects. In particular, during blanking and forming there are no parts highly stressed by a large punch stroke. In this respect, the cutting sleeve 11 has to make only a stroke which is limited at one end by the shoulder 10 and at the other end by the step 13. Because of the reduced sleeve stroke, the compression of the spring 15 is not appreciable.

The expulsion of the caps formed by the punches 24 is facilitated both by the slightly conical shape of these latter and by feeding compressed air through the ducts 26–33, so that the caps 64 remain inside the cylindrical elements 49.

In the practical embodiment of the invention the technical details, may vary according to requirements.

This particularly applies to the thickness and material of the caps.

Particular attention must therefore be given to the shape of the edges of the punch 24 and the cylindrical elements 49 in order to obtain uniform sliding of the sheet metal during the stage in which the punch 24 penetrates into the well defined by the cylindrical elements 49, in order to prevent puckering, bending and other similar defects.

I claim:

1. A blanking and forming press for caps of sheet metal comprising a stationary base member, at least one cylindrical seat provided in said base member, a sleeve slidable guided in said seat and having one end portion defining an outer blanking edge and the opposite end portion provided with an outer collar arranged between a shoulder and an abutting step which are formed inside said seat, elastic means arranged in said seat and axially urging said sleeve in a resting position in which said collar abuts against said step and said one end portion extends out of said seat, said elastic means permitting said collar to abut against said shoulder when the sleeve is forced in the opposite direction, a first ram member movably supported with respect to said stationary base member on one side thereof, a rod extending through said sleeve and coaxially thereto and having one end connected to said first ram member, a forming punch connected to the opposite end of said rod, a cutting ring arranged between said forming punch and said rod, said ring being guided in said sleeve, a second ram member movably supported with respect to said stationary base member and on the side thereof opposite to that on which the first ram is located, a cylindrical die coaxial to said rod and supported by said second ram member, said cylindrical die having an inner blanking edge cooperating with the outer blanking edge of said sleeve, a cylindrical drawing element positioned inside said die and defining an axial bore for receiving the punch and the cutting ring, said element forming a recess with said die for receiving the one end portion of said sleeve, a presser plate elastically supported by said stationary base member and arranged between the latter and the second ram member, means for moving said first and second ram members toward and away from the stationary base member thus permitting positioning of a sheet metal between the presser plate and the cylindrical die when the ram members are spaced apart from the base member and then causing, as the ram members approach each other, clamping of the sheet metal between the cylindrical die and the presser plate, penetration of the sleeve within said recess, whereby a circular sheet metal disc is blanked and then clamped between said sleeve and cylindrical element, advancing the punch against said disc thus causing the clamped portion of the disc to slip within said bore and trimming of the peripheral portion of the disc by said cutting ring.

2. A press as claimed in claim 1 in which an expelling unit is provided comprising a rod arranged in said bore and coaxially to said punch and having a head guided in said bore, elastic means urging said rod in a rest position, stationary stop means being further provided arranged to engage with said rod when said second ram member is moved away from said base member thus causing relative movement between said head and second ram member and expulsion of the formed cap.

* * * * *